United States Patent [19]

Neely

[11] Patent Number: 5,060,379

[45] Date of Patent: Oct. 29, 1991

[54] FOLDING KNIFE APPARATUS

[76] Inventor: Vaughn O. Neely, 666 Grand Ave., Mancos, Colo. 81328

[21] Appl. No.: 604,126

[22] Filed: Oct. 29, 1990

Related U.S. Application Data

[63] Continuation-in-part of Ser. No. 445,425, Dec. 4, 1989, abandoned.

[51] Int. Cl.[5] ..... B26B 1/00; B26B 1/06; B26B 1/04; B26B 1/08

[52] U.S. Cl. ..... 30/161; 30/160; 30/157; 30/155

[58] Field of Search ..... 3/32, 148, 155, 159, 3/160, 161, 163, 164; 7/118

[56] References Cited

U.S. PATENT DOCUMENTS

| | | | |
|---|---|---|---|
| 1,478,260 | 12/1923 | Sibley | 30/160 |
| 3,896,546 | 7/1975 | Hildebrandt | 30/157 |
| 4,893,409 | 1/1990 | Poelmann | 30/155 |

FOREIGN PATENT DOCUMENTS

| | | | |
|---|---|---|---|
| 2306050 | 10/1976 | France | 30/157 |

*Primary Examiner*—Frank T. Yost
*Assistant Examiner*—Paul M. Heyrana, Sr.
*Attorney, Agent, or Firm*—H. Gordon Shields

[57] ABSTRACT

Folding knife apparatus includes a blade having a tang secured to a case or housing. Wedging action between the tang and the case locks the blade open and closed. The tang includes a longitudinally extending slot, and the case or housing includes a pin extending through the longitudinally extending slot. A spring is disposed in the slot and biases the blade against the pin to help lock the blade in place, particularly in the open, use position. Axial movement of the blade is required to unlock the blade from its open position in order to pivot the blade. A cam relationship exists between a portion of the tang and a portion of the case or housing to urge the blade to the closed position.

22 Claims, 2 Drawing Sheets

FOLDING KNIFE APPARATUS

CROSS REFERENCE TO RELATED APPLICATION

This application is a continuation-in-part application of copending application Ser. No. 07/445,425, filed Dec. 4, 1989, and now abandoned 08/08/90.

BACKGROUND OF THE INVENTION

1. Field of the Invention

This invention relates to folding knives and, more particularly, to a folding knife having a blade urged to the closed position and having a positive lock in the open position.

2. Description of the Prior Art

U.S. Pat. No. 220,438 (Slayton) discloses a combination razor and knife in which the blade includes a longitudinal slot. The housing for the blade includes a pin which extends through the slot and the blade is movable relative to the housing in two directions. The blade moves longitudinally by means of the slot and pin to lock the blade in the open position and in the closed position.

U.S. Pat. No. 338,853 (Marks) discloses a combination knife and fork element which utilizes a slot on the blade and a pin extending through a housing and disposed in the slot. The blade is accordingly movable relative to the housing by means of the slot. The housing also includes a slot extending inwardly from one edge, and the blade includes a stud which moves into the slot when the blade is folded into the housing to secure the blade into the housing.

U.S. Pat. No. 588,174 (Praunegger) discloses a folding knife, fork, or spoon apparatus which includes a longitudinal slot in one of the elements and a pin in the housing disposed in the slot. The blade is moved axially to lock the blade in the open position and also to lock the blade in the closed position.

U.S. Pat. No. 825,212 (Henkel) discloses a nail file utilizing a diagonally extending slot on the nail file blade and a pin on the housing. The blade is locked by moving the blade relative to the pin.

U.S. Pat. No. 2,183,901 (Weaver) discloses a pocket knife system utilizing a fixed pin and different slot arrangements. A pin extends through the various slots and is secured to the housing. Knife blades pivot on the pin and the knife blades are moved relative to the pin by means of the slots to lock the blades. Each blade, in addition to a slot, also includes a notch which cooperates with the pin and the blade in the locking environment.

U.S. Pat. No. 2,286,524 (Wilbur) discloses a springbiased locking arrangement for the folding blade of a pocket knife. A spring is used to bias elements into a locking relationship with a plurality of blades. The springbiased element is pulled outwardly against the bias of the spring in order to unlock the various blades to allow the blades to move.

U.S. Pat. No. 4,240,201 (Sawby et al) discloses a folding knife which utilizes a safety lock system which includes a plurality of cam elements and a bar spring.

U.S. Pat. No. 4,604,803 (Sawby) discloses another type of folding knife which utilizes a springbiased element to lock the blade. The springbiased element must be moved out of the way in order to fold the blade. The blade base, or the portion of the tang of the blade secured to the handle is moved laterally in order to free the blade from the cooperating locking elements.

All of the above-referenced patents include limitations of one form or another. In some apparatus, the blades may be moved inadvertently, and in other apparatus the actuation is relatively complicated because of the interconnection of the mechanical elements. The apparatus of the present invention overcomes the deficiencies of the prior art by providing a positive lock which requires a positive movement in order to move the knife blade from its open, use position to fold the knife blade into its closed position in the handle or case.

SUMMARY OF THE INVENTION

The invention described and claimed herein comprises a folding knife which includes a generally longitudinally extending slot on the tang of the knife blade and a pin which extends through the handle or case for the blade. Wedging action between the blade and the handle locks the blade in the open position. A spring is disposed in the slot to provide a positive bias between the blade and the pin to help hold the blade in both the open and closed positions. In addition, there is a cam surface on the rear portion or tang of the blade which cooperates with a mating portion of the case or handle to urge the blade to its fully closed position.

Among the object of the present invention are the following:

To provide new and useful knife apparatus;

To provide new and useful folding knife apparatus;

To provide new and useful knife apparatus in which wedging action locks the blade in the open position;

To provide new and useful knife apparatus in which the blade is locked in its open and closed positions by spring biasing action;

To provide new and useful knife apparatus having a blade movable relative to a case;

To provide new and useful knife apparatus having a movable blade and an axially extending slot in the tang of the blade which cooperates with a pin on a blade housing and a spring in the slot disposed between the pin and the end of the slot; and To provide new and useful knife apparatus having a blade movable longitudinally to open and to close the blade and in which the blade pivots to nearly one hundred eighty degrees between its closed and open positions.

DESCRIPTION OF THE PREFERRED EMBODIMENT

Figure 1:
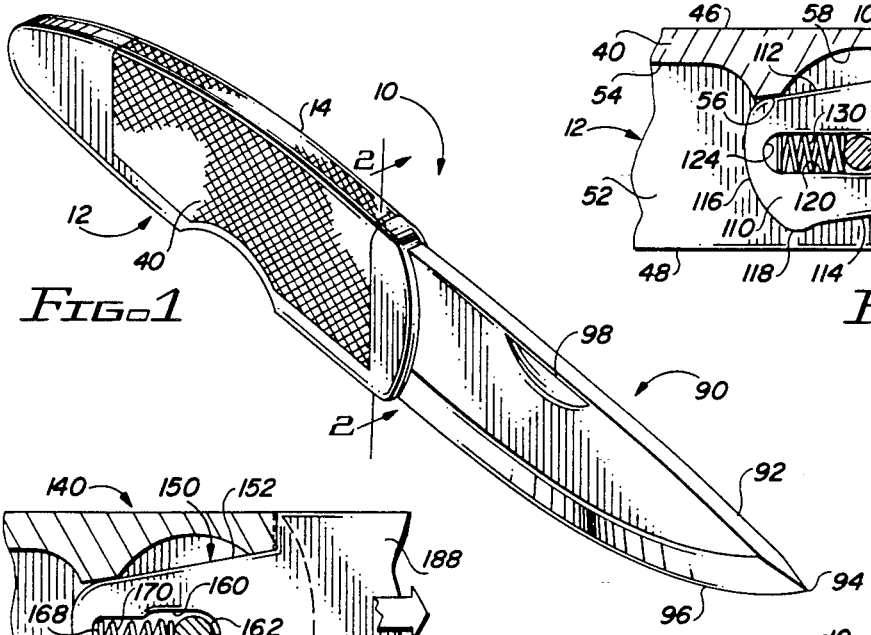
FIG. 1 is a perspective view of the apparatus of the present invention.

FIG. 1 is a perspective view of folding knife apparatus 10 of the present invention. The knife apparatus 10 includes a handle and case 12 and a blade 90. The blade 90 folds into and out of the handle and case 12. With the blade 90 folded into the case 12, the case comprises a housing for the blade. With the blade 90 open, the case 12 comprises a handle.

Figure 2:
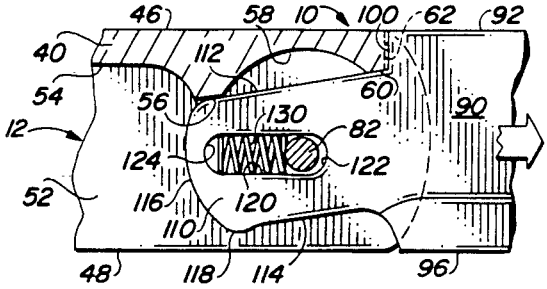
FIG. 2 is a view in partial section of a portion of the apparatus of FIG. 1, taken generally along line 2—2 of FIG. 1.
Figure 3:
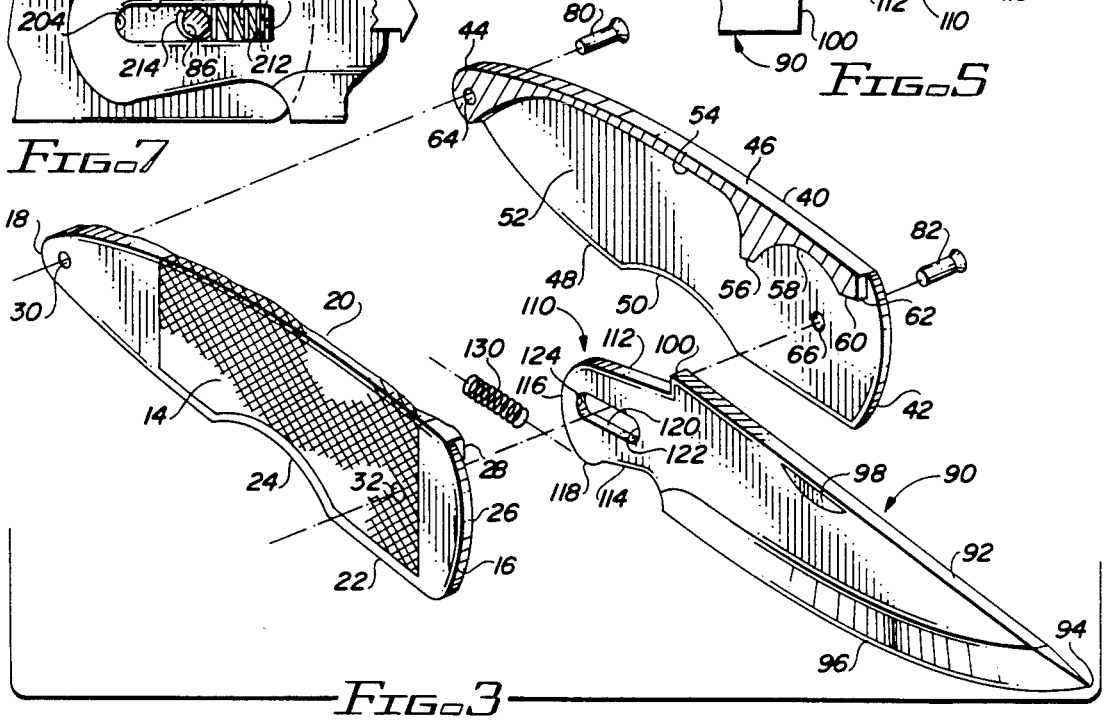
FIG. 3 is an exploded perspective view of the apparatus of FIG. 1.

FIG. 2 is a view in partial section taken generally along line 2—2 of FIG. 1. It comprises a side elevational view of a portion of the apparatus of the present invention. FIG. 3 is an exploded perspective view of the knife apparatus 10 of the present invention. FIGS. 4A, 4B, 4C, 4D, and 4E are sequential views illustrating the operation of the folding knife apparatus 10 of the present invention. For the following discussion, attention will primarily directed to FIGS. 1, 2, 3, and 4A–4E.

The handle and case 12 includes two sides, a side 14 and a side 40. The side 14 is best shown in FIG. 3. The side 14 includes a rounded front end 16 and a tapered rear end 18. The side 14 also includes a top edge 20 and a bottom edge 22. The bottom edge 22 includes a bottom, concavely configured relieved portion 24. The relieved portion 24 is a finger indentation which cooperates with a portion of the blade to aid in opening the knife 10.

The side 14 also includes an interior relieved portion 26. The relieved portion 26 is generally of the same configuration as the interior of the side 40, which will be discussed in detail below, and which is also best illustrated in FIG. 3.

Adjacent to the rounded front end 16 is an upper front shoulder 28. Beneath the shoulder 28 is an open area or interior relieved portion in which the blade 90 is disposed.

Extending through the side 14 are two apertures. The apertures include a rear aperture or hole 30 and a front aperture or hole 32. The holes or apertures 30 and 32 cooperate with fastening elements, discussed in detail below, to secure the two sides 14 and 40 together, and to secure the blade 90 to the handle and case 12.

The side 40 is substantially a mirror image of the side 14. The side 40 includes a rounded front end 42 and a tapered rear end 44. A top edge 46 extends between the front end 42 and the rear end 44. A bottom edge 48 extends between the front end 42 and the rear end 44. Extending upwardly into the bottom edge 48 is a relieved portion 50. The two handle sides 14 and 40 are aligned with each other when the two sides are secured together to comprise the case or housing and the handle 12.

The side 40 includes an interior relieved section 52. The relieved section or area 52 includes several different portions, including a blade nesting and relieved surface portion 54, a lower rear wedging surface 56, a concavely configured or curved relieved portion 58, and a lower front wedging surface 60. At the front of the side 40 is an upper front shoulder 62.

The surface or shoulder 28 of the side 14 and the surface or shoulder 62 are aligned with each other. The surfaces 28 and 62 comprise front shoulders which a portion of the blade 90 is adjacent to when the blade 90 is in the open position. The surface 60 and its complementary surface on the side 14, comprise wedging surfaces, as do the surface 56 and its complementary portion on the side 14. These surfaces or shoulders cooperate with surfaces on the blade 90 to lock the blade 90 in its open and closed positions, as will be explained in detail below.

The side 40 also includes a pair of holes or apertures, including a rear aperture 64 and a front aperture 66. The apertures or holes 64 and 66 are appropriately aligned with the holes or apertures 30 and 32 to secure the sides 14 and 40 together, with the blade 90 disposed between them.

An appropriate rear locking element 80, such as a rivet, extends through the aligned apertures 30 and 64 to secure the rear portions of the sides 14 and 40 together. A pin element 82 extends through the aligned apertures 32 and 66 to secure the front portion of the sides 14 and 40 together, with the blade 90 secured therebetween. The pin 82 serves as both a front securing element for the sides 14 and 40 and a pivot pin for the blade 90. The blade 90 pivots on the pin element 82, as best shown in FIGS. 4A, 4B, 4C, 4D, and 4E. This will be discussed in detail below.

The blade 90 includes a generally flat top surface 92, a front point 94, and a bottom cutting edge 96 extending downwardly and rearwardly from the point 94. The top surface 92, while "flat" on top, may include a slight curve, if desired; it need not be straight.

Figures 4A, 4B, 4C, 4D, 4E:
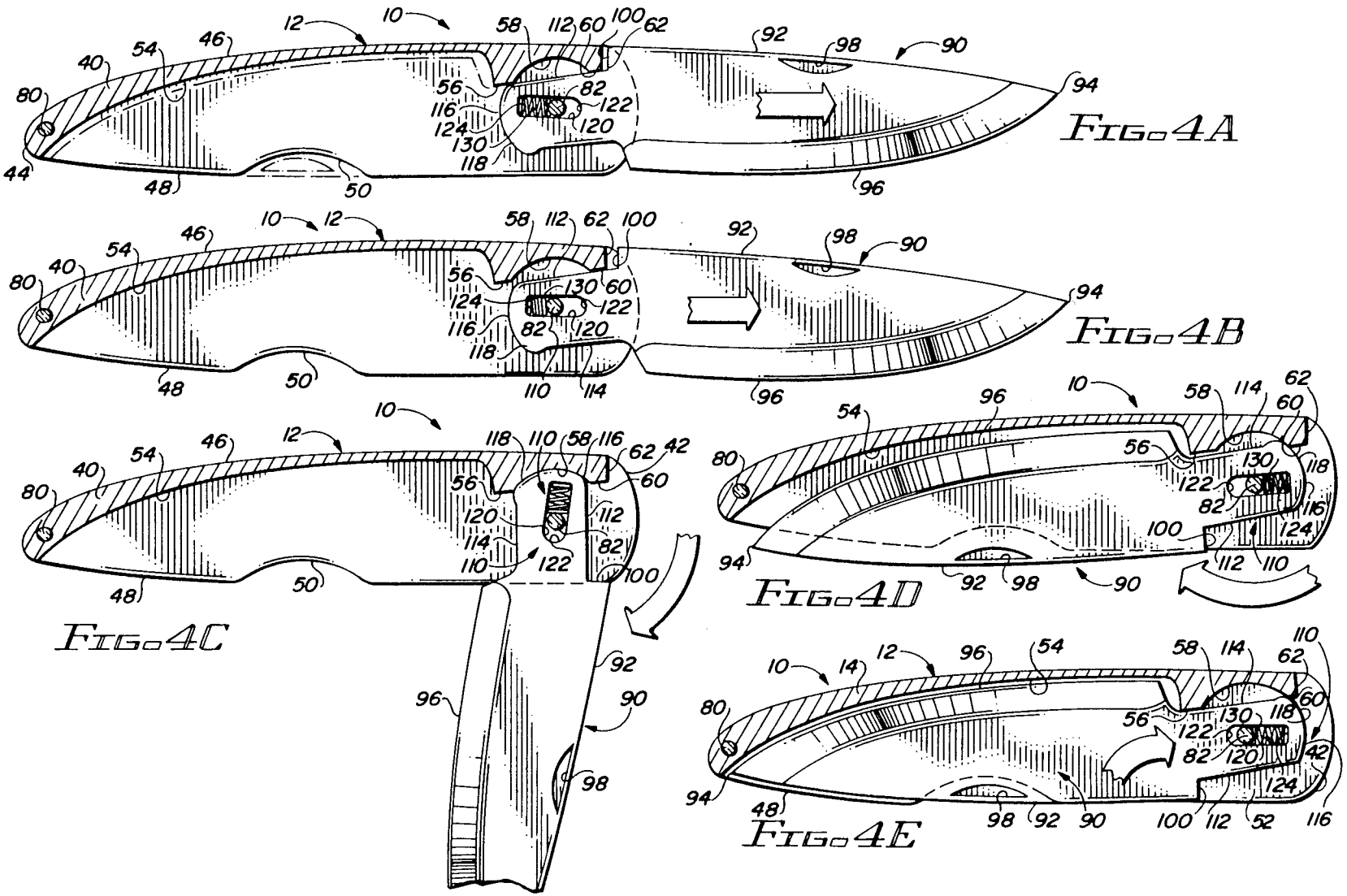
FIGS. 4A, 4B, 4C, 4D, and 4E are side views in partial section sequentially illustrating the operation of the apparatus of the present invention.

The blade 90 includes a relieved portion 98, or indentation, which may be used in opening and closing the blade 90. The relieved portion or indentation 98 extends inwardly from one side of the blade. There may be an aligned relieved portion or indentation on the opposite side of the blade 90 from the relieved portion or indentation 98. The indentation 98 is aligned with the concave portions 24 and 50 of the sides 14 and 40, respectively, when the blade 90 is closed. This is best shown in FIG. 4E.

Extending generally outwardly from the rear end of the blade 90 is a tang 110. A top rear shoulder 100 extends between the top surface 92 of the blade 90 and the tang 110.

The tang 110 includes a top surface 112 and a bottom surface 114. The surface 112 extends generally rearwardly from the shoulder 100. The bottom surface 114 extends generally rearwardly from the rear portion of the cutting edge 96.

Figure 5:
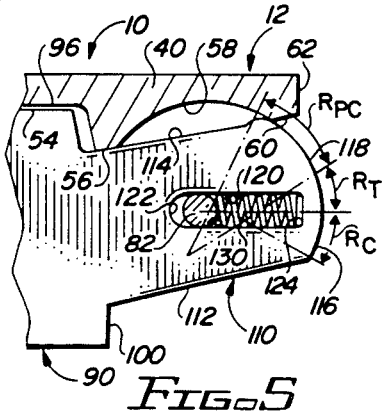
FIG. 5 is an enlarged side view of a portion of the apparatus of the present invention.

At the rear of the tang 110 is a convexly rounded end 116. The end 116 extends generally arcuately between the top surface 112 and a cam portion or surface 118 which is adjacent to the bottom surface 114. The cam portion or surface 118 is at the bottom of the tang 110, and is a relatively small convexly curved portion extending or disposed between the bottom surface 114 and the rounded end 116. The cam portion 118 is actually a continuation of the rounded end 110, but with a particular radius of cervature, as is best shown in FIG. 5, and as will be discussed in detail below.

Extending generally axially in the tang 110 is a slot 120. The slot 120 includes a front end 122 and a rear end 124. The pin or shank portion of the pin or fastening element 82 extends through the slot 120. The width of the slot 120 is generally the same as the diameter of the shank of the fastening element 82, or just slightly wider so as not to interfere with the pivoting or movement of the blade 90 and its tang 110 on the fastening element 82 relative to the handle and case 12, as illustrated in FIGS. 4A–4E and as discussed below.

As clearly shown in the drawing figures, the slot 120 is generally axially extending in the tang 110, but it is not parallel to the surfaces 110 and 114. Rather, the slot 120 is generally parallel to or aligned with the longitudinal axis of the blade 90. The tang 110 extends generally downwardly at a slight angle to the longitudinal axis of the blade 90 when the blade is in the open position. This is best shown in FIGS. 2, 3, 4A, and 4B.

A spring 130, which is preferably a compression spring, is disposed in the slot 120 between the fastening element 82 and the end 124 of the slot 120. The primary purpose of the compression spring 130 is to bias the tang 110, and accordingly the blade 90, rearwardly against the wedging surfaces 56 and 60, and the corresponding surfaces in the side 14. As best shown in FIG. 2, the compression spring 130 biases the end 122 of the slot 120 towards the fastening element or pin 82.

In the open position of the knife, as illustrated in FIG. 2, the top surface 112 of the tang 110 is disposed against the wedging surfaces 56 and 60 of the handle 40, and the shoulder 100 of the blade 90 is disposed adjacent to or against the shoulder or surface 62 of the handle 40. The knife blade 90, due to the geometrical configuration or angular orientation of the various surfaces or shoulders, is in its open or use position of the knife apparatus 10 in FIG. 2, and is locked there in the open position by the bias of the compression spring between the pin 82 and the end 124 of the slot 120 and the wedging action of the surfaces 56, 60, and 112 (and the corresponding elements, not shown, in the side 14).

The spacing 130 biases the tang 110 and the blade 90 axially rearwardly. The aligned surfaces 56 and 60 are disposed at an acute angle downwardly from the longitudinal axis of the blade 90 and the slot 120 in the tang 110. The top surface 112 of the tang 110 is similarly at a slight acute angle relative to the longitudinal axis of the slot 120 and to the longitudinal axis of the blade 90. The result of the spring bias is a wedging action between the aligned surfaces 56 and 60 of the handle and/or case 12 and the top surface 112 of the tang 110. The wedging action effectively locks the blade 90 in the open position.

In FIG. 2 the shoulders 62 and 100 of the case 12 and the blade 90, respectively, are shown adjacent to each other in an abutting relationship. The abutting relationship may be aesthetically desirable, but it is not functionally necessary. That is, it is not an abutting relationship between the two shoulders 62 and 100 which locks the blade 90 in its open positions. Rather, it is the wedging action between the aligned surfaces 56, 60, and the surface 112 which locks the blade 90 in its open position. The shoulders 62 and 100 may be spaced apart as shown in dotted line in FIG. 2, if desired.

Figure 6:
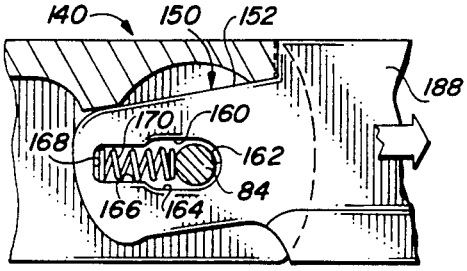
FIG. 6 is a view in partial section illustrating an alternate embodiment of the apparatus of FIG. 2.
Figure 7:
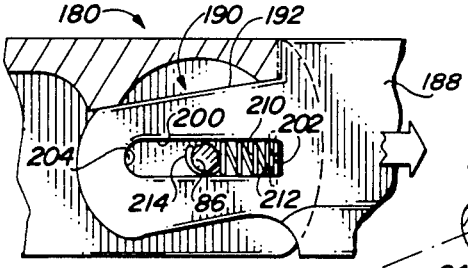
FIG. 7 is a view in partial section illustrating another alternate embodiment of the apparatus of FIG. 2.

A similar space is also shown in dotted line between the corresponding elements of the embodiments of FIGS. 6 and 7. No further discussion will be made regarding those corresponding elements because the embodiments of FIGS. 6 and 7 pertain to other features of the apparatus of the present invention, and only the pertinent elements or parts are discussed in conjunction with those Figures. However, it is deemed desireable to be consistent with respect to the "standard" or "normal" features of the apparatus of the present invention as shown in those Figures. Hence the dotted line showing of a space between the case and blade shoulders in FIGS. 6 and 7.

In FIG. 2 there is shown a space between the pin 82 and the end 122 of the slot 120 when the blade 90 is locked in its open position. Thus, neither the pin 122 nor the shoulder 62 are disposed in an abutting relationship with the tang 110 and the blade 90, respectively, when the blade 90 is locked in its open position or condition of the knife apparatus 10.

Referring primarily to FIGS. 4A, 4B, 4C, 4D, and 4E, the sequential operation of the knife apparatus 10 in folding the knife from its open, use position as shown in FIG. 2, is illustrated and will be discussed. Only the pertinent portions of the side 40 will be discussed. However, it will be understood that the side 14 includes corresponding portions, as stated previously. Relatively large, open arrows are shown in the Figures to illustrate the various movements of the blade 90.

In FIG. 4A, a longitudinally or axially outward movement of the blade 90, away from the handle or case 12, causes the spring 130 to begin to compress. The pin 82 moves farther away from the front end 122 of the slot 120, and the top surface 112 of the tang 110 moves forwardly along the surface 56 of the handle side 40.

A continued outward movement of the blade 90, to the position shown in FIG. 4B, allows the top surface 112 of the tang 110 to clear the surface 56. The blade 90 may then be pivoted downwardly, or clockwise, as shown in FIG. 4C. The end 116 of the tang 110 then moves into the concave relieved portion 58.

Once the top surface 112 clears the surface 56, there is no longer any reason for the continued outward pull on the blade 90. The rounded rear end 116 and the cam surface 118 of the tang 110 move into the relieved portion 58, and the compression spring 130 continues to provide a bias between the shank of the fastening element or pin 82 and the end 124 of the slot 120 to cause the surfaces 116 and 118 to generally move on or in the curved surface 58.

Due to the angular orientation of the slot 120 relative to the longitudinal axis of the tang 110, there is an added downward bias produced by the changing radius of the cam surface 118 which tends to push or bias the blade 90 by a snap action to the closed position. In the closed position the bottom surface 114 of the tang 110 is against the surface 56. The surface 56 comprises a limiting or stop surface for defining the closed configuration of the knife 10.

The bias of the compression spring 130 holds the blade 90 in its closed position until the biasing action of the spring 130 between the end 124 of the slot 120 and the pin 82 has been overcome to move the cam surface 114 away from the surface 56 in opening the blade. This opening movement is a combination of an axial movement and a pivoting movement of the blade 90.

Referring again particularly to FIGS. 4A and 4E, it will be understood that the bias of the spring 130 prevents the blade 90 from falling free from the case or handle 12. The angular relationship between the longitudinal axis of the slot 120 and the surfaces 112 and 114 of the tang 110 provides the directional force for the spring 130 to bias the blade 110 in both its open and its closed positions. Thus, a definite force, as illustrated by the large open arrows in FIGS. 4A, 4B, 4C, and 4D, is required to overcome the bias of the spring to move the blade 90 from its open position (see FIG. 2) to its fully closed position (see FIG. 4E). The same thing is true for opening the blade.

A positive force must be applied to the blade 90 to move the blade 90 relative to the pin 82 and to the handle or case 12 in order to open the blade from the closed position shown in FIG. 4E. The opening procedure is then accomplished in the reverse manner from that described above to close the blade. Thus, moving backward from FIG. 4E, the cam surface 118, and the rear surface 116, moves into the relieved portion 58, and the blade 90 is then moved counter-clockwise towards its full open position.

If a pivoting force is applied on the blade to move it from its closed position to its open position, and axial movement also occurs inherently because of the geometry of the various elements involved. Accordingly, to open the knife, one need not apply an axial force on the blade. Rather, the axial movement of the blade will follow automatically from or with the pivoting movement.

The blade continues to move counterclockwise until it is in the position shown in FIG. 4B. From the position shown in FIG. 4B, the bias of the compression spring 130 causes the tang 110 and the blade 90 to move to the left. That is, the compression spring extending between the pin 82 and the end 124 biases the tang 110 and the blade 90 to the left. The surface 112 moves on, and relative to, the surfaces 56 and 60 of the tang 110 until the wedging action locks the blade 90 to the case 12 due to the geometry of the slot 120 and the tang surface 112 and the aligned wedging surfaces 56 and 60 of the case or handle 12.

The wedging relationship between the top surface 112 an the wedge surfaces 56 and 60 limits the movement of the blade 90. This is shown in FIGS. 2 and 4A. The blade 90 is then locked in its open position. The blade 90 will remain in its locked position until an axially outward force is applied to the blade 90 to cause the surface 112 of the tang 110 to move away from the wedge surface 56 and accordingly to let the rear portion 116 of the tang 110 extend into the relieved portion 58. With the rear portion 116 of the tang 110 in the relieved portion 58, the blade 90 may pivot to its closed position.

Referring again particularly to FIGS. 2 and 4A, it will be noted that the surface 112 comprises a planar surface disposed against the aligned wedge surfaces 56 and 60. If a line were drawn along the surface 112 rearwardly from the tang 110, such line would intersect a line extending longitudinally through the pin 82 and along the longitudinal axis of the slot 120 at an acute angle. Accordingly, it may be understood that a wedging action exists between the surface 112 and the surfaces 56 and 60 by the action of the spring 130 acting along the longitudinal axis of the slot 120 and the pin 82. This wedging action locks the blade 90 in the open position of the knife apparatus 10.

FIG. 5 is an enlarged view of a portion of the knife apparatus 10 illustrating in more detail the rounded end 116 of the tang 110 and the cam surface portion 118 of the tang. Essentially, FIG. 5 is an enlarged view of a portion of FIG. 4E. However, for purposes of clarifying the surfaces 116 and 118, lines have been drawn illustrating the various radii of curvature of the rounded end portions 116 and 118 of the tang 110.

Essentially, the rounded end portions 116 and 118 comprise areas having generally three different types of radii. The first portion 116 includes an angular portion of constant radius designated $R_c$, with the radius of the portion $R_c$ being drawn generally from a point on the longitudinal axis of the slot 120. The second portion of substantial importance in the apparatus of the present invention is the cam portion 118, which is a radius designated $R_{pc}$ having a parabolic curve with a different center. The parabolic portion is designated as the cam section 118. Between the two portions is a transition curve portion, indicated as transition radius or $R_r$ in FIG. 5. The portion $R_r$ is also included in the first portion 116. That is, the portion of the rounded end designated by reference numeral 116 includes both the $R_c$ and $R_r$ portions.

For purposes of the cam action, or the snap action discussed above, as the $R_c$ and $R_p$ portions of the end 116 move out of the relieved portion 58 as the blade 90 is pivoted closed, the bias of the spring 130 between the end 124 of the slot 120 and the pin 82 exerts an increasing bias on the tang 110 and on the blade 90 to urge the blade 90 to its closed position. When the end portion 116 moves out of the relieved portion 58, the changing or decreasing radius of the cam portion 118, together with the bias of the spring 130, exerts the snap action to urge the blade 90 to its closed position. The closed position, as indicated above, is when the bottom surface 114 of the tang 110 is disposed against the surface 56 of the case side portion 40. It will be noted that the relieved portion 58 is of a generally constant radius, which mates conveniently with the $R_c$ portion of the rounded end 116 (see FIG. 4C).

As illustrated in both FIGS. 4E and 5, a portion of the tang 110 remains in the relieved portion 58 when the blade 90 is in its full closed position.

The constant urging of the spring 130 by or through the angular or geometrical relationship discussed above, tends to hold the blade 90 in its closed position, thus preventing the blade 90 from inadvertently moving out of the housing 12. Accordingly, there must be a positive force exerted on the blade 90 to cause the blade 90 to move against the bias of the spring 130, and also against the cam action of the cam portion 118 and the relieved portion 58 of the housing or case 12 which tends to cause the blade 90 to remain in its closed position.

FIG. 6 is a side view of an alternate embodiment of the apparatus of FIGS. 1–4. Specifically, the embodiment illustrated in FIG. 6 is an alternate embodiment tang 150 and related structure. The tang 150 has substantially the same external configuration as does the tang 110 discussed above. However, the tang 150 includes a slot 160 which is configured differently from the slot 120 of the tang 110. The slot 160 includes an end 162, and the shank portion of a fastener or pin 84 extends through the slot 160. In the open position of the knife apparatus 140, the pin 84 is disposed adjacent to the end 162 of the slot 160. Rearwardly of the slot 160 is a slot or slot portion 166. The slot 166 is simply a narrowed continuation of the slot 160. The width of the slot portion 166 is slightly less than the diameter of the pin 84. A shoulder 164 extends between the slot 166 and the slot portion 160. The slot 166 extends between the shoulder 164 and an end 168. The compression spring 170 is disposed in the slot 166 and extends between the end 168 and the pin 84.

The overall length of the slot 166 is greater than the fully compressed length of the spring 170. Accordingly, the spring 170 cannot be compressed beyond its limit because the farthest outward movement of the tang 150 will only be the distance between the end 162 of the slot 160 and the shoulder 164 since the pin 84 cannot move into the slot 166. The shoulder 164 limits the movement of the tang relative to the pin 84. The spring 170 accordingly may not be fully compressed, and certainly may not be overly compressed beyond its limit. Any outward movement of the tang 150 occasioned by a longitudinal pull on the blade of the knife apparatus 140 will not cause an overcompression of the spring 170.

The same geometrical relationship exists between the longitudinal axis of the aligned slots 160 and 166 and a top surface 152 of the tang as with the corresponding elements of the tang 110.

FIG. 7 is a side view of an alternate embodiment of the knife apparatus 180. The knife apparatus 180 includes a blade 188 and a blade tang 190. The tang 190 includes a top surface 192 and a slot 200. The shank or pin portion of a fastener 86 extends through the slot 200. The slot 200 includes a front end 202 and a rear end 204. A tension spring 210 extends between the pin 86 and an anchor pin 212 adjacent to the end 202 of the slot 200. The tension spring 210 includes a hook portion 214 which is disposed about the pin 86.

While the springs 130 and 170 have both been compression springs, the spring 210 is a tension spring, which impresses a tension bias between the pin 86 and the anchor pin 212 which is secured to the tang 190. In all respects, the knife apparatus 180 operates substantially the same as the knife apparatus 10, discussed above. Similarly, the knife apparatus 140 operates in substantially the same manner as the knife apparatus 10. The difference between the knife apparatus 10 and the knife apparatus 140 is, of course, in the configuration of the double width slot portions 160 and 166, and the limiting of the compressing of the spring 170. In the knife apparatus 180, a tension spring 210 is used instead of the compression spring 130 or 170. The tension spring 210 is, of course, on the "opposite" side of the fastener shank or pin 86 and exerts a pull between the tang and the pin rather than a push, as with the knife apparatus 10 and the knife apparatus 140.

Once again, there is an acute angle between the top surface 192 and the longitudinal axis of the slot 200 to provide the appropriate geometry to effect the wedging action to lock the blade 188 open.

In all three embodiments, an axially outward pull on the respective blades is required in order to close the knife apparatus. The blade in each embodiment is locked in its open position by the bias of the respective compression and tension springsand a wedging action between the tangs and wedge surfaces in the cases/handles.. The general outer configuration of the tangs, and the angular orientation of the slots remains substantially as discussed above in detail in conjunction with the knife apparatus 10.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Folding knife apparatus, comprising, in combination:

handle and case means for supporting a blade when the knife apparatus is in an open, use position and for receiving the blade when the knife apparatus is in a closed, storage position, including wedging means for providing wedging action for locking the blade in the open and closed positions;

blade means pivotally secured to the handle and case means, including a blade, a tang extending outwardly from the blade and having a top surface adapted to contact the wedging means of the handle and case means for defining the open position of the knife apparatus, a bottom surface on the tang adapted to contact the wedging means of the handle and case means for defining the closed position of the knife apparatus, and slot means in the tang;

a pin secured to the handle and case means and extending through the slot means in the tang; and spring means disposed in the slot means and against the pin for providing a bias to urge the top surface of the tang against the wedging means to lock the knife apparatus in the open position and for providing a bias to urge the blade means to the closed position as the blade is pivoted from its open position to its closed position.

2. The apparatus of claim 1 in which the handle and case means further includes a concavely curved portion, and the blade means further includes a rounded end on the tang, and the rounded end extends into the concavely curved portion as the blade means moves between its open and closed positions.

3. The apparatus of claim 2 in which the rounded end on the tang further includes a first curved portion and a second curved portion adapted to move sequentially in the concavely curved portion, and the second curved portion comprises a cam portion cooperating with the concavely curved portion to urge the blade means to the closed position.

4. The apparatus of claim 1 in which the wedging means includes a front wedge surface and a rear wedge surface.

5. The apparatus of claim 4 in which the handle and case means further includes a concave portion between the front and rear wedge surfaces.

6. The apparatus of claim 5 in which the blade means further includes a rounded end on the tang, and the rounded end is disposed in the concave portion as the blade means is moved between its open and closed positions.

7. The apparatus in claim 5 in which the blade means further includes a rounded end on the tang, and the rounded end is disposed in the concave portion as the blade moves between its open and closed positions, and the rounded end includes a cam portion which cooperates with the concave portion to urge the knife apparatus to its closed position under the bias of the spring means.

8. The apparatus of claim 1 in which the blade means further includes a convexly rounded end and the slot means includes a first end adjacent to the convexly rounded end and a second end remote from the convexly rounded end.

9. The apparatus of claim 8 in which the spring means comprises a compression spring extending between the pin and the first end to bias the top surface of the tang against the wedging means in the open position of the knife apparatus.

10. The apparatus of claim 8 in which the spring means includes an anchor pin disposed in the slot and a tension spring secured to and extending between the pin and the anchor pin for providing the bias.

11. The apparatus of claim 8 in which the slot means includes a first portion having a first width, and a second portion having a second width which is greater than the first width, and the pin is disposed in the second portion, and the spring means is disposed in the first portion and extends to the pin in the second portion.

12. The apparatus of claim 11 in which the pin has a diameter which is greater than the first width.

13. The apparatus of claim 12 in which the slot means further includes a shoulder between the first and second portions for limiting the movement of the pin.

14. The apparatus of claim 1 in which the handle and case means includes a first side and a second side, and each side includes a relieved portion into which the blade means is disposed in the closed position and into which the tang is disposed and from which the blade extends in the open position.

15. The apparatus of claim 1 in which the handle and case means further includes a concavely curved portion, and the blade means further includes a rounded end on the tang and a bottom surface on the tang.

16. The apparatus of claim 15 in which the blade moves outwardly against the bias of the spring means to move the top surface of the tang away from the wedging means to allow the rounded end of the tang to move into the concavely curved portion to pivot the blade from the open position to the closed position.

17. The apparatus of claim 15 in which the wedge means includes a first wedge surface and a second wedge surface, and the concavely curved portion is disposed between the first and second wedge surfaces, and the first wedge surface comprises a lower limiting surface against which the bottom surface of the tang is disposed in the closed position of the knife apparatus.

18. The apparatus of claim 17 in which the first wedge surface and the second wedge surface are aligned with each other, and the top surface of the tang is disposed against both the first and second wedge surfaces when the knife apparatus is in the open position.

19. Folding knife apparatus, comprising, in combination:

handle and case means for supporting a blade when the knife apparatus is in an open, use condition and for receiving the blade when the knife apparatus is a closed, storage condition, including a front wedge surface for limiting the movement of the blade in the open condition, and a rear wedge surface aligned with the first wedge surface for limiting the movement of the blade in both the open and the closed positions;

blade means pivotally secured to the handle and case means, including a blade having a cutting edge, a tang extending outwardly from the blade, a top surface on the tang for contacting the front and rear wedge surfaces to define the open position of the knife apparatus;

a slot in the tang having a first end adjacent to the blade and a second end remote from the blade;

a pin secured to the handle and case means and extending through the slot in the tang; and spring means disposed in the slot and against the pin for providing a bias to urge the top surface on the tang against the front wedge surface and the rear wedge surface in the open position.

20. The apparatus of claim 19 in which:

the handle and case means further includes a concavely curved portion between the front and rear wedge surfaces;

the blade means further includes a rounded end on the tang remote from the blade and having a first curved portion and a second curved portion adapted to sequentially extend into and move in the concavely curved portion, with the second curved portion comprises a cam portion cooperating with the concavely curved portion to urge the blade means to the closed condition; and the spring means further provides a bias to urge the blade means to the closed position as the blade is pivoted and when the second curved portion of the rounded end moves in the concavely curved portion of the handle and case means and the first curved portion of the talng moves out of the concavely curved portion.

21. The apparatus of claim 20 in which the slot in the tang has a longitudinal axis, and a line drawn along the longitudinal axis intersects a line along the top surfaces of the tang at an acute angle, and a wedging action between the top surface of the tang and the front and rear wedge surfaces is provided by the bias of the spring means in the slot.

22. The apparatus of claim 19 in which the blade means further includes a bottom surface on the tang for contacting the rear wedge surface of the handle and case means for defining the closed condition of the knife apparatus.

* * * * *

UNITED STATES PATENT AND TRADEMARK OFFICE

CERTIFICATE OF CORRECTION

PATENT NO. : 5,060,379

DATED : Oct. 29, 1991

INVENTOR(S) : VAUGHN O. NEELEY

It is certified that error appears in the above-identified patent and that said Letters Patent is hereby corrected as shown below:

On the title page, under item [19] and in item [76]:

The inventor's surname was misspelled.

"NEELY" should read -- NEELEY --.

Signed and Sealed this

Twenty-third Day of February, 1993

*Attest:*

STEPHEN G. KUNIN

*Attesting Officer*

*Acting Commissioner of Patents and Trademarks*